US005508710A

United States Patent [19]

Wang et al.

[11] Patent Number: 5,508,710

[45] Date of Patent: Apr. 16, 1996

[54] CONFORMAL MULTIFUNCTION SHARED-APERTURE ANTENNA

[75] Inventors: Johnson J. H. Wang, Marietta; Victor K. Tripp, Tucker, both of Ga.

[73] Assignee: Wang-Tripp Corporation, Marietta, Ga.

[21] Appl. No.: 212,554

[22] Filed: Mar. 11, 1994

[51] Int. Cl.[6] ..... H01Q 21/00; H01Q 1/36

[52] U.S. Cl. ..... 343/726; 343/895; 343/727

[58] Field of Search ..... 343/700 MS, 727, 343/728, 895, 726, 741, 853, 866, 713, 729, 748; H01Q 7/00, 5/00, 1/36

[56] References Cited

U.S. PATENT DOCUMENTS

| | | | |
|---|---|---|---|
| 3,665,481 | 5/1972 | Low et al. | 343/762 |
| 3,916,417 | 10/1975 | Wong et al. | 343/854 |
| 4,081,803 | 3/1978 | Dempsey | 343/795 |
| 4,117,488 | 9/1978 | Perrotti | 343/100 |
| 5,053,786 | 10/1991 | Silverman et al. | 343/895 |
| 5,083,134 | 1/1992 | Saitou et al. | 343/713 |
| 5,128,687 | 7/1992 | Fay | 343/754 |
| 5,160,936 | 11/1992 | Braun et al. | 343/725 |
| 5,175,555 | 12/1992 | Holak et al. | 342/175 |
| 5,300,936 | 4/1994 | Izadian | 343/728 |
| 5,313,216 | 5/1994 | Wang et al. | 343/700 MS |

OTHER PUBLICATIONS

Dual–Frequency Antenna with Dichroic Reflector and Microstrip . . . , C. A. Chen and T. K. Tung, Antennas and Propagation, vol. 1 (1982 APS Symp.) May 24–28, 1982.

Meharry et al., 6 to 18 GHz Transmit/Receive Modules for Multifunction Phased Arrays, 1989 IEEE MTT–S Internat'l Microwave Symp. Digest, Jun. 13–15, 1989.

*Primary Examiner*—Donald Hajec
*Assistant Examiner*—Tan Ho
*Attorney, Agent, or Firm*—Hopkins & Thomas

[57] ABSTRACT

A shared aperture, multifunction conformable antenna has a spiral-mode microstrip (SMM) antenna portion having a spacer for maintaining the SMM antenna in spaced relationship to a ground plane, with dielectric material therebetween. The SMM antenna portion is substantially surrounded by a loop antenna which is spaced therefrom and which is electrically connected to the spiral-mode portion by a high frequency choke to block FM broadcast band signals from the SMM antenna. An AM-broadcast-band-blocking capacitor functions to route AM signals to the SMM antenna portion. The spiral-mode antenna receives signals at frequencies above 300 MHz, the loop antenna receives signals in the FM band, and both the loop antenna and the spiral-mode antenna receive signals in the AM band.

22 Claims, 7 Drawing Sheets

CONFORMAL MULTIFUNCTION SHARED-APERTURE ANTENNA

FIELD OF INVENTION

This invention relates to antennas, and, more particularly, to a shared aperture, multifunction conformable antenna.

BACKGROUND OF THE INVENTION

In the recent past and up to the present day, there has been a proliferation of wireless electronic systems for use in a variety of applications and functions on vehicles such as cars, trucks, boats and aircraft. Each of these systems operates in a frequency band that is generally different from the other systems and, as a consequence, each requires an antenna operable in the particular frequency band. Such vehicles as airplanes, boats, and cars are generally equipped for one-way or two-way radio communication in various frequency bands, and also require the appropriate antenna for each particular communication band used. It can be appreciated that equipping a vehicle with a separate antenna for each frequency band of the several electronic systems can present a serious problem, especially in terms of available suitable space for mounting an antenna and for the space occupied by the antenna.

As a consequence, considerable effort has been directed to reducing the number of antennas required and to reducing the space which the antennas occupy. These efforts, at least in part, have been directed to producing a single antenna capable of handling two or more systems, i.e., a single multifunction shared aperture antenna. Such a multifunction antenna desirably should have a wide, although not necessarily continuous, bandwidth and also have both radiation pattern and polarization diversity. These requirements are due to the fact that different electronic systems operate at different frequencies and generally require different radiation patterns and polarizations. In the case where the antenna is to be mounted on aircraft, or missiles, aerodynamic considerations require that the antenna protrude as little as possible from the vehicle surfaces, e.g., the fuselage. In the case of an automobile or truck, there is a need to reduce protrusion of the antenna for protection thereof against breakage or other damage or vandalism. Other factors such as privacy, security and aesthetic appearance are also to be considered. In all such cases there has been an effort to develop conformal antennas which may be mounted on or integrated into the fuselage of an airplane or the rooftop of an automobile, for example, and which conform to the contour or profile thereof.

Unfortunately, present day multifunction antennas which satisfy the aforementioned criteria are virtually non-existent, although a multifunction antenna is shown in U.S. Pat. No. 4,711,488 of E. J. Perrotti. Most antennas which satisfy the requirement of comformability do not have bandwidths that exceed thirty percent (30%) hence the range of frequencies accommodated by the antenna is severely limited. In addition, most multifunction antennas at the present time are usually of the high directivity type and incapable of adequate omni-directional or broad beamed operation. See, for example, U.S. Pat. No. 5,160,936 of Braun et al. and "6 to 18 GHZ Transmit/Receive Modules for Multifunction Phased Arrays," 1989 IEEE MTT-S International Microwave Symposium Digest, Vol. 1, pp. 115–118, Long Beach, Calif., Jun. 13–15, 1989.

In U.S. patent application Ser. No. 07/962,029, filed by the present inventors now U.S. Pat. No. 5,313,216, issued May 17, 1994, the disclosure of which is incorporated herein by reference, including the discussion of the prior art, there is shown a multi-octave microstrip antenna which is conformable. More particularly, that application shows a spiral mode microstrip (SMM) antenna having a broad bandwidth (presently approximately 900%), conformability, and a low profile. The antenna basically comprises a spiral-mode antenna element and a substrate for spacing the element a selected distance from a ground plane. Preferably, the antenna element comprises a thin foil of conducting material, such as copper, having a frequency independent pattern form such as a spiral, sinuous, tooth, or log-periodic pattern. In addition, an optional loading material is positioned adjacent the periphery of the patterned element, and the antenna feed is located at the center of the pattern. The antenna as described has a bandwidth characteristic comparable to that of prior frequency-independent antennas, and also has conformability to any mounting surface. Such an antenna also represents an improvement over prior art antennas in that it is low profile and conformable, and possesses both radiation pattern and polarization diversity.

Despite the improvements in performance characteristics resulting from the SMM antenna's unique configuration, there are certain frequency bands in use in automobiles, for example, where the performance of the SMM antenna can be improved, thereby achieving a greater multifunction characteristic.

SUMMARY OF THE INVENTION

The present invention is a conformable antenna arrangement which represents a utilitarian expansion of the SMM antenna capabilities and characteristics. Although the antenna of the invention and the features and principles thereof are amenable to a wide variety of applications, for illustrative purposes the invention will be described in the context of its application to an automobile. In such an application, it is highly desirable to limit the physical dimensions of the antenna so that it may easily be integrated into the roof of the automobile as a hidden, non-protruding antenna. Thus, an antenna panel of approximately two feet square by one inch depth represents a size that facilitates such integration.

The antenna of the invention comprises a substantially flat spacer member such as a panel having a spiral mode microstrip antenna (SMM) on one surface thereof. The panel itself is preferably of a low dielectric material in accordance with SMM antenna design criteria, such as a honeycomb structure, and is approximately one inch or less thick with a suitable ground plane member mounted on the other surface thereof. The dielectric constant of the spacer material, which, in certain configurations, may be air, is preferably within the range of 1 to 4.5. Also, the spacer between the SMM antenna and the ground plane member can be air, with suitable supporting spacer or spacers holding the two elements apart. The thickness of the panel is small in relationship to the operating wavelengths of the antenna and is governed by the particular SMM antenna design. The panel is preferably approximately two feet in diameter, or it may be a two foot by two foot square although these dimensions are not restrictive. The axis of the spiral antenna is normal to the flat panel, and, as shown in the aforementioned application of Wang, the antenna feed is located at the center of the spiral. Surrounding the spiral antenna and spaced therefrom is a loop or ring antenna, with the loop antenna feed being located on the loop with one arm thereof connected to the ground plane. The loop antenna is designed to be resonant over the FM band (88–108 MHz), and the spiral antenna covers most frequencies above the FM band. The loop antenna is connected to one arm of the spiral antenna by means of an inductive choke which blocks the FM band from the spiral antenna while permitting passage of the AM frequency band (530–1610 KHz) to the spiral. The AM frequencies are blocked from the grounded terminal of the loop antenna by means of a blocking capacitor. In such a configuration, both the loop and the spiral serve the AM band, but only the loop accommodates the FM band, and only the spiral accommodates the frequencies above the FM band. The diameter of the ground plane is approximately equal to the diameter of the spiral or SMM antenna so that adequate SMM antenna operation is realized without interference with the FM loop antenna, and hence the diameter of the loop antenna, which, as pointed out hereinbefore, surrounds and is spaced from the spiral antenna, is greater than the diameter of the ground plane.

It is to be understood that the terms "flat" and "parallel" and "plane" are intended to include the antenna configuration in its conformed state, wherein a somewhat convex or concave shape may be imparted to the antenna assembly. Thus, "parallel" can mean equidistant, and "plane" can imply a continuity of surface, curved or flat.

In another embodiment of the invention, the loop is formed as a circular folded dipole antenna whose ends are connected by means of a current-smoothing capacitor. The capacitor performs the function of producing a fairly uniform current distribution along the circumference of the folded dipole, thereby producing a substantially uniform omni-directional pattern. Viewed another way, the capacitor reduces the dipole mode and enhances the loop mode. The smoothing capacitor is not strictly necessary, but, in its absence, limitations are placed on the diameter of the dipole ring. The dipole ring is preferably on the same plane as the spiral antenna, and can be formed on the circuit board substrate at the same time as the spiral antenna. On the other hand, the folded arms of the dipole may lie in the plane of the ground plane, which permits an increase in the width of the conductive members forming the folded dipole, i e , they are made "fatter", which, in turn, produces a broader frequency bandwidth.

One advantage of the antenna of the invention is that it is predominantly horizontally polarized. Inasmuch as most FM transmission is either horizontally or circularly polarized, the antenna of the invention has a better polarization match with the transmitted signal than does the vertically polarized whip antenna in common use on vehicles today. In addition, the present antenna is mounted on the roof of a vehicle, thus it is positioned higher on the vehicle than the conventional whip antenna which is generally mounted on a truck lid, fender, or dash board, thereby leading to better signal reception.

Another advantage of the present antenna when mounted on the vehicle roof is that it is located on the high point of the vehicle and has a substantially uninterrupted azimuthal radiation pattern. The conventional whip antenna, on the other hand, which, as noted before, is generally mounted on a fender or the trunk lid of the vehicle, and its pattern is blocked in certain directions by other parts of the vehicle, such as the passenger compartment, leading to variations of as much as 15 to 30 dB in the radiation pattern.

As is pointed out in the aforementioned Wang application, the pattern of the SMM antenna need not be a simple two-arm Archimedean spiral. The configuration may be a sinuous, interdigitated, multi-arm or other configuration so long as the requirements of the SMM antenna performance are met.

These and other features and advantages of the present invention will be more readily appreciated and understood from the following detailed description, read in conjunction with the accompanying drawings.

DETAILED DESCRIPTION

Figure 1B:
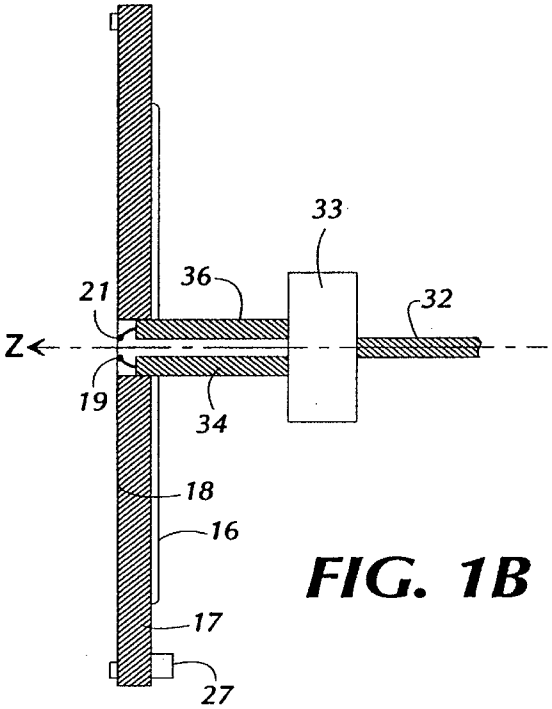
FIG. 1B is a side elevation view of the antenna of FIG. 1A.
Figure 1D:
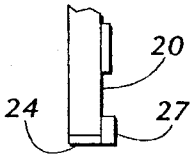
FIG. 1D is a partial view of another variation of the arrangement of FIG. 1B.
Figure 1C:
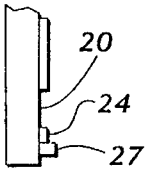
FIG. 1C is a partial view of a variation of the arrangement of FIG. 1B.
Figure 1A:
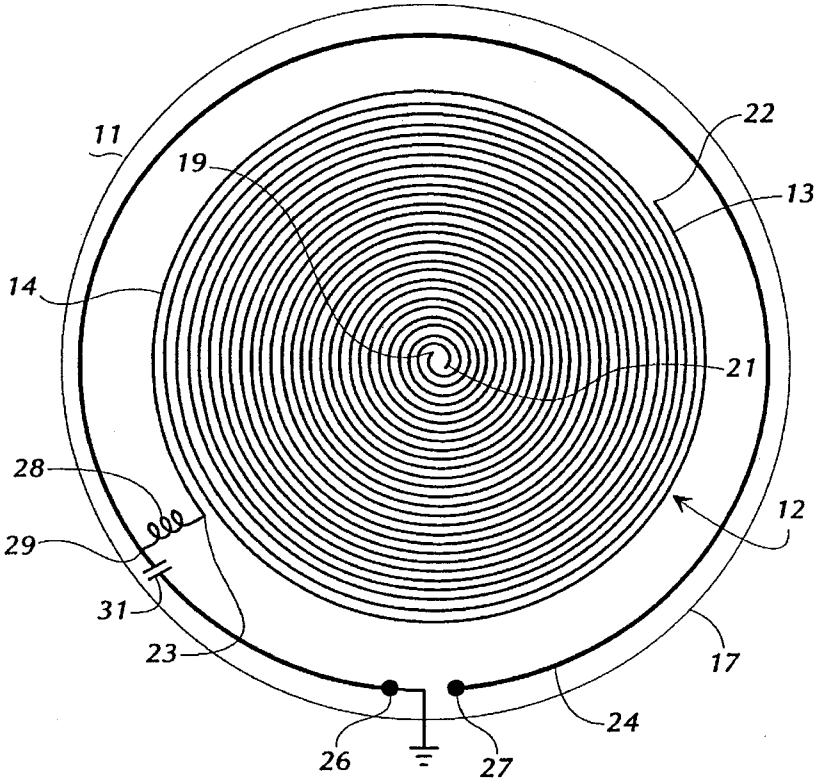
FIG. 1A is a plan view of a first embodiment of the antenna of the invention.

The multi-octave microstrip antenna 11 of FIGS. 1A and 1B comprises a spiral member 12 having first and second spiral arms 13 and 14 mounted above a ground plane 16 and spaced therefrom by a panel 17 of a material having a low dielectric constant. The spiral member 12 preferably is formed from a thin metal foil, such as copper foil and preferably has a thin backing member 18 of dielectric material upon which the face or plating is fixed. The spiral arms 13 and 14 originate at input/output terminals 19 and 21, respectively, at the center of the spiral, and spiral outwardly therefrom to terminate at ends 22 and 23 respectively, thereby defining a circle of diameter D. The foil forming the spiral is preferably approximately twenty (20) mils or less, although other thicknesses can be employed provided the foil is thin in terms of a wavelength, such as, for example, one one-hundredths (0.01) of a wavelength. Although the ground plane 16 is shown in FIGS. 1A and 1B as a separate element, the antenna may be constructed as a single unitary structure including its own ground plane.

Surrounding spiral member 12 and spaced therefrom by two inches or more is a loop antenna 24, also mounted on the surface of dielectric spacer 17 and having input/output terminals 26 and 27 where terminal 26 is preferably, but not necessarily, connected to the ground plane for feeding to or receiving from to the loop 24 AM and FM signals. A spacing of approximately two (2) inches or more is needed between the loop conductor and the rest of the metallic structure, which includes the spiral and the ground plane which lies under the spiral and may exist outside of the antenna structure. Spiral antenna 12 is most efficient at frequencies greater than 300 MHz, and loop antenna 24 is most efficient at FM frequencies, while both antenna elements 12 and 24 are capable of contributing to the AM reception. In order that the signals in the FM frequency band be isolated from the spiral 12, and frequencies above 300 MHz be isolated from the loop, the space between loop 24 and spiral 12 is bridged by a high frequency choke 28, connected to the end 23 of arm 14 of the spiral and to loop 24 at point 29 as shown. Choke 28, which may be, for example, approximately 0.5 micro-henries, effectively blocks signals in the aforementioned bands, but permits passage of signals in the AM band, so that both spiral 12 and loop 24 contribute to AM reception. On the other hand, it is desirable that the AM signals be prevented from simply being connected directly to terminals 26 and 27 around the loop, which would effectively shunt out spiral 12. To this end, an AM blocking capacitor 31 is provided in loop 24 between terminal 26 and the connecting point 29 of choke 28. Blocking capacitor 31, which may be, for example, approximately 250 pico-farads, in effect causes the AM signal to be routed through choke 28 to spiral 12, while representing substantially a short circuit to the FM signals on loop 24. Ground plane 16 is approximately the same diameter D as spiral 12, which is less than the diameter or dimensions of spacer 17 and of loop 24 so that the ground plane 16 does not interfere with the performance of loop 24. On the other hand, spacer 17, which may be approximately one inch (1.0") thick, protects the loop antenna 24 from the metallic parts of the vehicle on which antenna 11 is mounted. Dielectric spacer 17 preferably has a dielectric constant of from one to two (1–2).

The antenna 11, as shown, is preferably mounted in the roof of a vehicle with its Z-axis pointing skyward. The assembly as shown is sufficiently flexible to allow it to conform to the curvature and profile of the vehicle roof used, as a consequence, it may form an integral part of the roof, with no protrusions.

Figure 3:
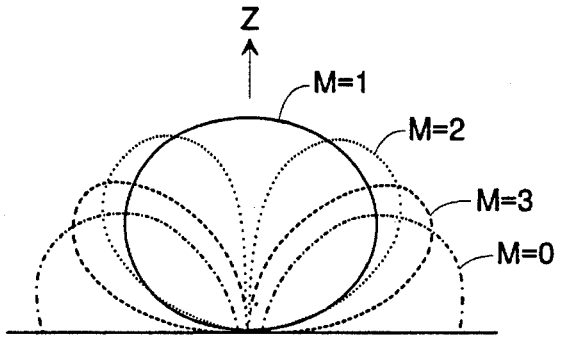
FIG. 3 depicts the radiation pattern of a plurality of modes for the SMM portion of the antenna of the present invention.

Signals above 300 MHz which are applied to the spiral 12 through a cable 32, a balun or an RF hybrid circuit 33, and feed cables 34 and 36 which are connected to terminals 19 and 21, respectively. For received signals, the sequence is, of course, reversed. Balun or hybrid circuit provides two output signals to cables 34 and 36 which are phase shifted relative to each other. For example, when the phase shift between signals is 180° relative to each other, a voltage is developed across terminals 19 and 21, causing spiral antenna 12 to radiate or receive in the n=1 mode, which, as explained in the aforementioned Wang et al. U.S. patent application Ser. No. 07/695,686, now U.S. Pat. No. 5,313,216, produces a single beam pattern as shown in FIG. 3. For mode n=0, the voltages at both terminals 19 and 21 are equal in phase and amplitude. The other mode patterns for the spiral antenna 12 can also be generated depending upon the phase shift produced by element 33 and the connections to the spiral. For received signals, the circuit 33 combines them(?).

Figure 2B:
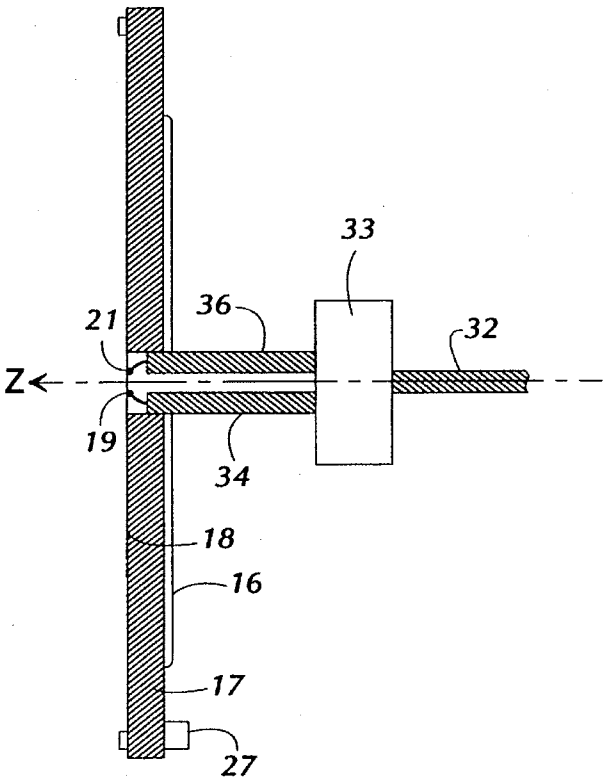
FIG. 2B is a side elevation view of the antenna of FIG. 2A.
Figure 2A:
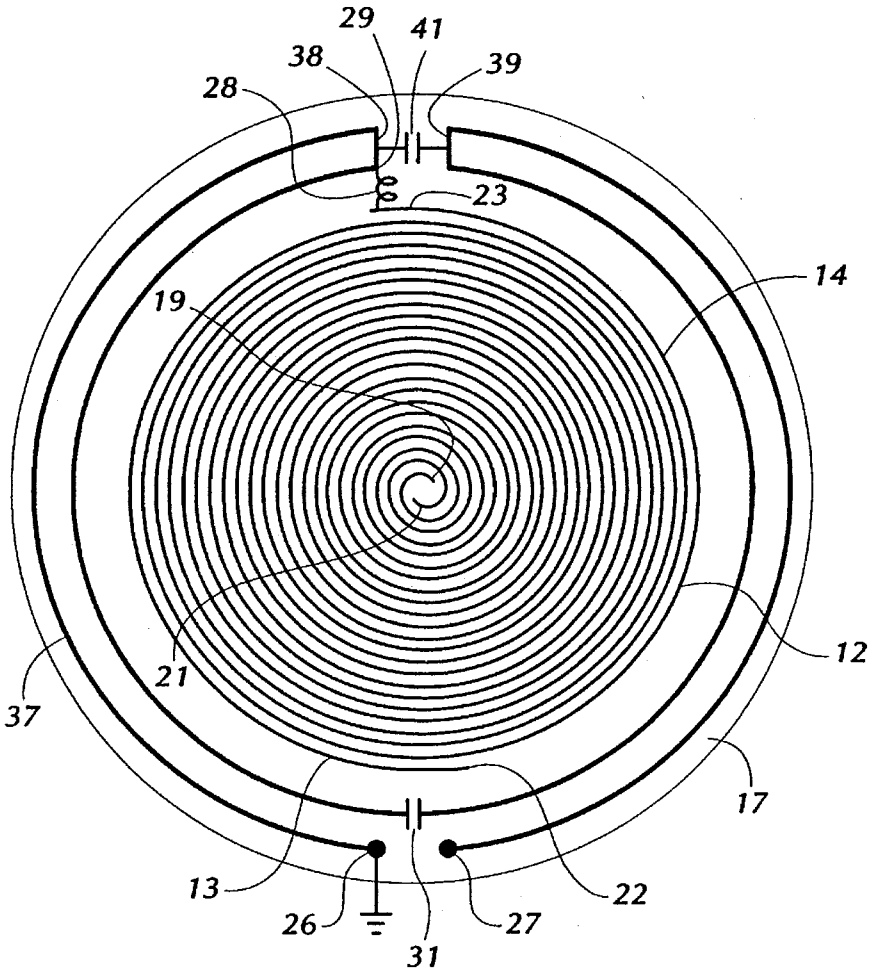
FIG. 2A is a plan view of a second embodiment of the antenna of the invention.

In FIGS. 2A and 2B there is shown a second embodiment of the present invention wherein the loop antenna 24 is replaced by a circular dipole antenna 37 having a folded dipole configuration. For simplicity and clarity those elements in FIGS. 2A and 2B which correspond to elements in FIGS. 1A and 1B bear the same reference numerals.

As can be see in FIG. 2A, the folded ends 38 and 39 are connected by a current smoothing capacitor 41 which functions to make the current distribution along the circumference of the dipole fairly uniform, thus producing the desired uniform omnidirectional pattern. Viewed another way, capacitor 41 reduces the dipole mode and enhances the loop mode. The folded dipole 37 of the antenna of FIGS. 2A and 2B can function acceptably for most applications at FM frequencies even without capacitor 41 provided its circumference is less than twenty-two inches (22"). The dipole can be on the same plane as spiral portion 14, or the arms thereof may be extended to the plane of the ground plane 16, although separated therefrom, as shown in FIG. 1C, or the arms of the folded dipole may span the distance between both planes, as shown in FIG. 1D. The advantage of the former is ease of manufacture inasmuch as dipole 37 can be etched on the same backing 18 as the spiral portion 14. The advantage of the latter is that it adds the vertical (Z) dimension to the dipole so that the volume spanned by the conductor forming the dipole can be increased, i.e., made "fatter" to achieve a broader bandwidth.

Capacitor 31 has a high impedance to AM signals, but is effectively a short circuit to FM signals. A value of approximately 250 pico-farads has been found to be adequate for capacitor 31 to function as intended. The location of capacitor 31 is not critical so long as it is placed on the arms away from the feed points, the inner arms of the folded dipole 27, for the configuration of FIG. 2A.

In FIG. 3 is shown the radiation pattern for the SMM spiral antenna 14, of both FIGS. 1A, 1B and 2A, 2B, which operates in spiral modes n=0, n=1, n=2, and n=3. The patterns shown are elevation patterns with the plane of the spiral antenna approximately parallel to the earth surface, as when it is integrated into an automobile roof top. The antenna may be made convex or concave to conform to the profile of the surface into which it is integrated without materially effecting the operation thereof. As can be seen in FIG. 3, mode n=1 is the only spiral mode that radiates in a unidirectional, broad-beam pattern. Modes n=0, n=2, and n=3 have omnidirectional (doughnut shaped) patterns and n=2 and n=3 are tilted vertically. Modes n=1 and higher orders generally have circularly polarized fields; however, dual linear polarization and dual sense circular polarization are also possible using the proper spiral configuration and feed.

In general, the circumference of an SMM antenna, such as antenna 14, must be chosen to be larger than $n\lambda$ where $\lambda$ is the wavelength of the lowest operating frequency intended. The requirement on circumference for mode n=0 is not rigid, but is preferably greater than that needed for mode n=1. At frequencies over 300 MHz, any pattern requirement for mobile wireless systems can generally be satisfied by one of modes n=0, n=1, or n=2. Cellular telephones, remote keyless entry (RKE) and other mobile communications that require omnidirectional coverage can employ mode n=0 or mode n=2. Global positioning systems (GPS) geolocation and certain satellite communications generally need mode n=1. If only modes n=0 and n=1 are to be used, spiral antenna 14 can have a spiral circumference that is slightly larger than $\lambda$. Thus, for mode n=0 and n=1 operations between 300 MHz and 3 GHz, the outer diameter of the spiral should be 12.5 inches or more, and the feed region (terminals 19 and 21) should be confined to a circle of one-half inch (0.5") or less.

If mode n=2 is to be included, the diameter of the spiral should be larger than twenty-five inches (25"). It is possible and feasible to operate outside of the prescribed range (300 MHz–3 GHz) by proper adjustments and trade-offs between the design parameters and performance requirements and also by the frequency-scaling method, known in the art. For example, operation up to 6 GHz can be had by a reduction in the feed region to a circle of one-quarter of an inch (0.25") and a reduction in the spacing between the spiral and the ground plane to approximately seven-tenths of an inch (0.7").

For AM reception, both the spiral antenna 14 and the loop 24 or folded dipole 37 contribute to the reception, as pointed out hereinbefore. In general, any antenna for AM reception functions more efficiently the greater its linear dimensions, inasmuch as the wavelengths can be as much as five hundred and sixty-one meters (561 m.) in the AM band. Thus, virtually all vehicle mounted AM antennas are electrically small, hence, inefficient. The connection of the outer end of the spiral antenna to the loop 24 or folded dipole 37 as shown in FIGS. 1A and 2A greatly increases the effective antenna length with a corresponding increase in AM reception efficiency.

As thus far described, the antenna of the present invention consists of an SMM section and a loop or folded dipole section. Other existing FM loop or ring designs can be adapted to the present invention with minor modifications. In FIG. 4, there are shown several possible alternative configurations which achieve the desired results. Thus, (A) is shown a square loop FM antenna, (B) a hula-hoop loop FM antenna, (C) an Alford loop A, (D) an Alford loop B, (E) a folded dipole A, (F) a folded dipole B, (G) a square loop with tuning stub, and (H) a spiral fed loop. Each of these alternative configurations has, on the loop or ring portion, a current distribution of essentially uniform amplitude and phase along the loop circumference. FM broadcasting is either horizontally or circularly polarized, depending on the particular station. As the radiated signal travels away from the transmitter, it gradually becomes depolarized, and at distances far from the transmitter, it often has equal vertical and horizontal components. Present day vehicle antennas are generally of the vertically oriented whip type, thus the present multifunction antenna, which is predominately horizontally polarized, has a generally better polarization match with the transmitter antenna than the whip antenna.

OPERATIVE RESULTS

Figure 5:
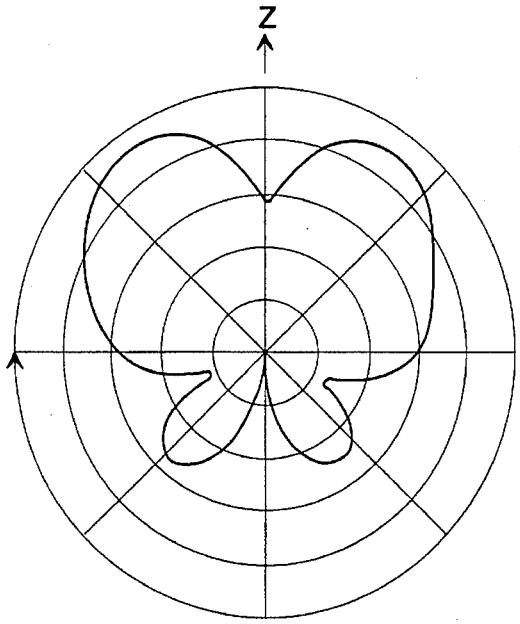
FIG. 5 depicts the radiation pattern of the antenna for the present invention at cellular telephone frequencies (825–890 MHz)

In FIG. 5 there is shown the elevation pattern of the antenna of the invention for vertical polarization of signals at the cellular telephone frequencies (825–890 MHz), with the Z-axis pointing skyward. This result is similar to that achievable with a whip antenna of the type currently used on automobiles.

Figure 6:
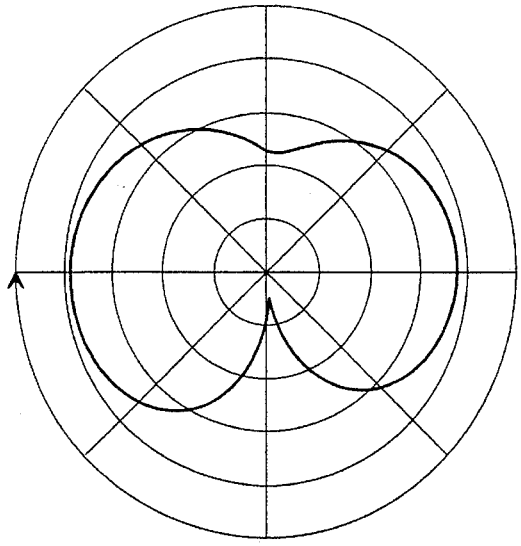
FIG. 6 depicts the radiation pattern of the antenna of the present invention at FM frequencies (88–108 MHz)
Figure 4A:
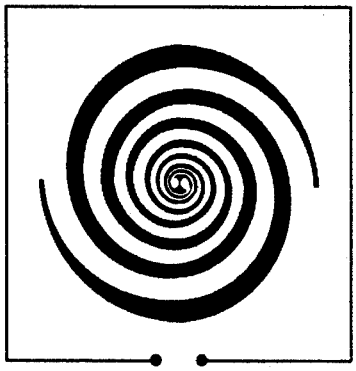
FIG. 4A through FIG. 4H depict alternative configurations for the antenna of the present invention.
Figure 4B:
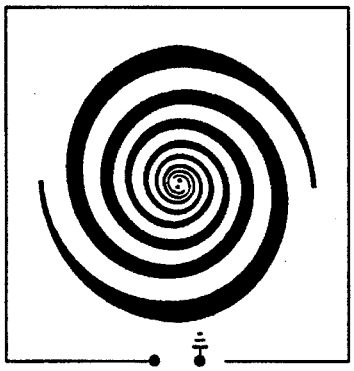
Figure 4C:
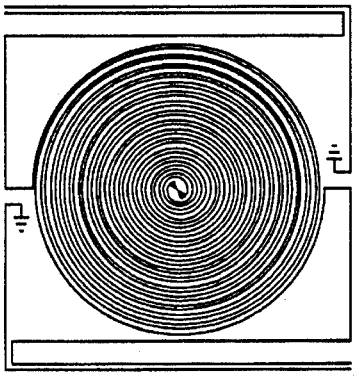
Figure 4D:
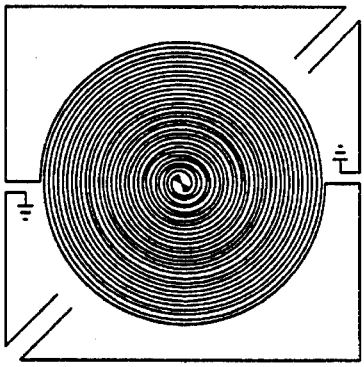
Figure 4E:
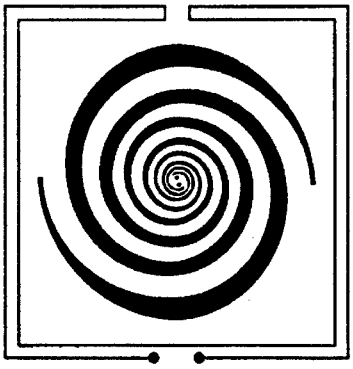
Figure 4F:
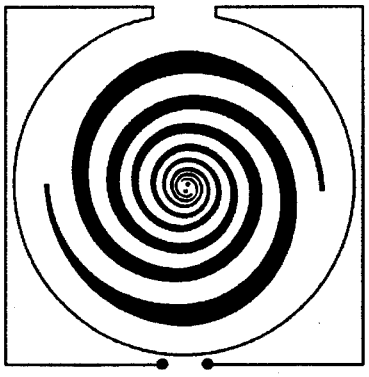
Figure 4G:
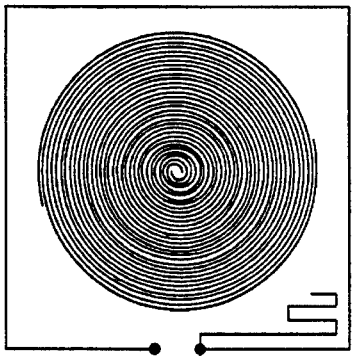
Figure 4H:
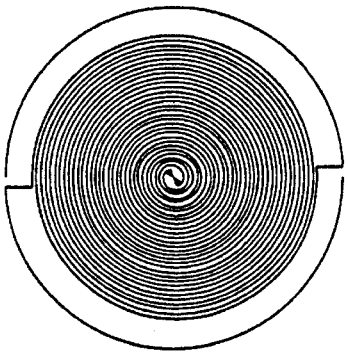
Figure 7A:
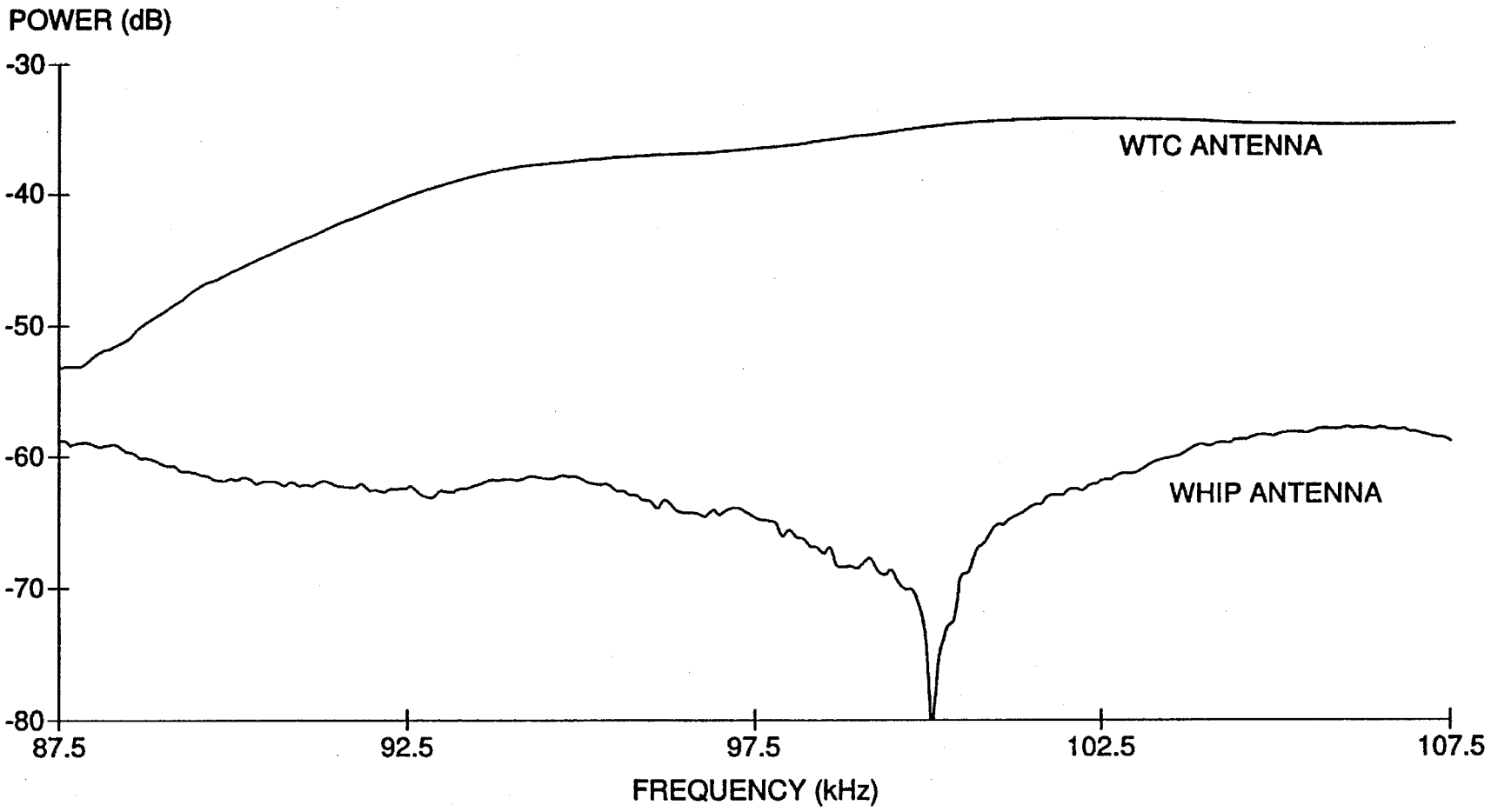
FIG. 7A is a graph of the relative sensitivities of the WTC (Wang-Tripp) antenna of the present invention and a conventional whip antenna for horizontally polarized FM signals.
Figure 7B:
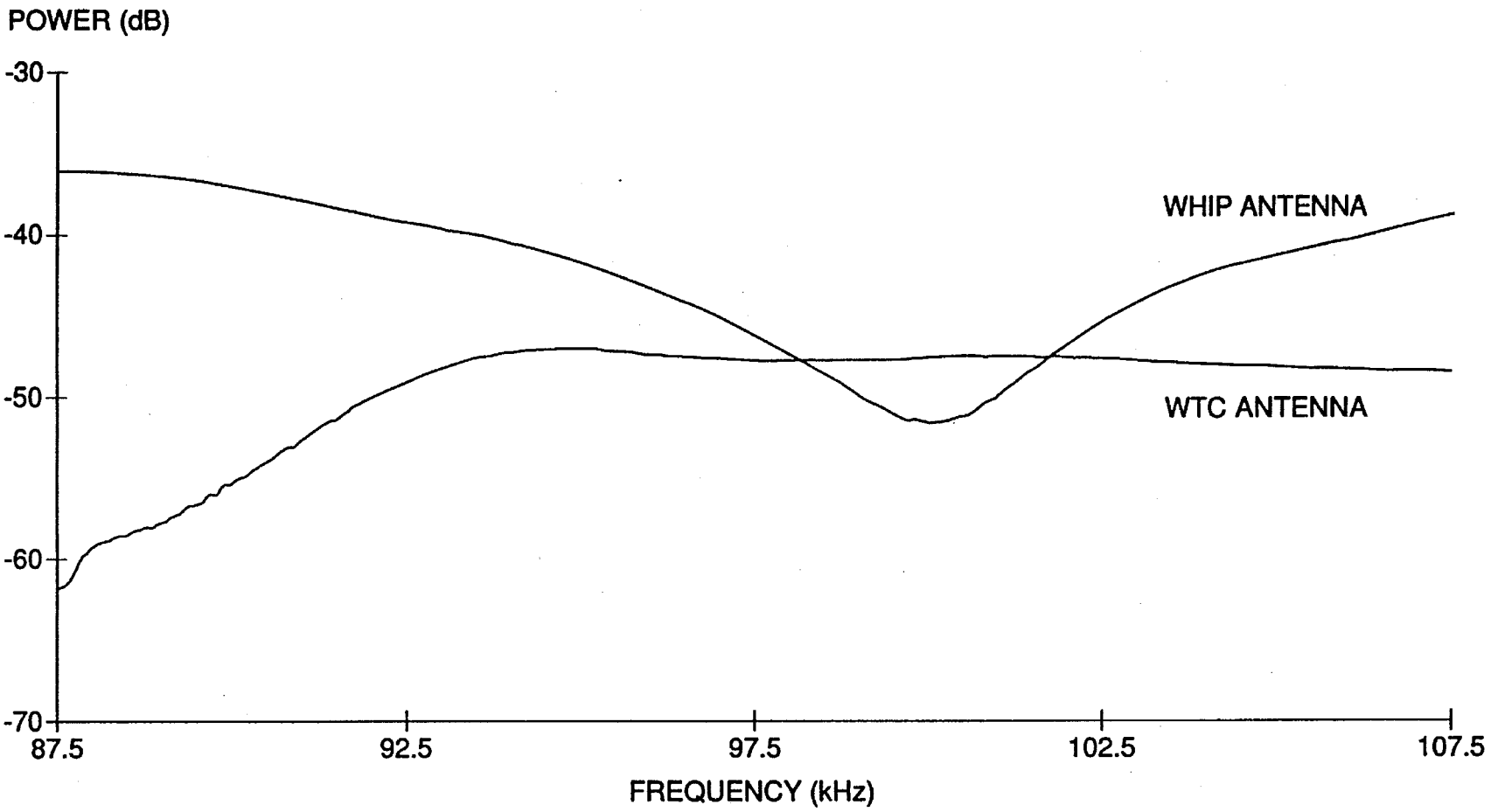
FIG. 7B is a graph of the relative sensitivities of the WTC antenna of the present invention and a conventional whip antenna for vertically polarized FM signals.

In FIG. 6 there is shown the elevation pattern of the antenna of the present invention for horizontal polarization of signals in the FM frequency band (88–108 MHz), with the Z axis pointing skyward. This pattern is superior to the resonant whip antenna (vertical polarization) currently used on automobiles. For virtually polarized FM signals, which, as pointed out hereinbefore, are unusual, the vertical whip antenna yields somewhat better performance, although the antenna of the invention displays adequate sensitivity. FIG. 7A is a graph of the comparative sensitivities for horizontally polarized FM signals, with the antenna of the invention being designated the WTC (Wang-Tripp) antenna, and FIG. 7B is a similar graph for vertically polarized FM signals. It can be seen that the performance of the antenna of the invention (WTC) is superior to that of the whip antenna for horizontal polarization, roughly equal thereto, beyond 92.5 MHz, for vertical polarization.

Figure 8A:
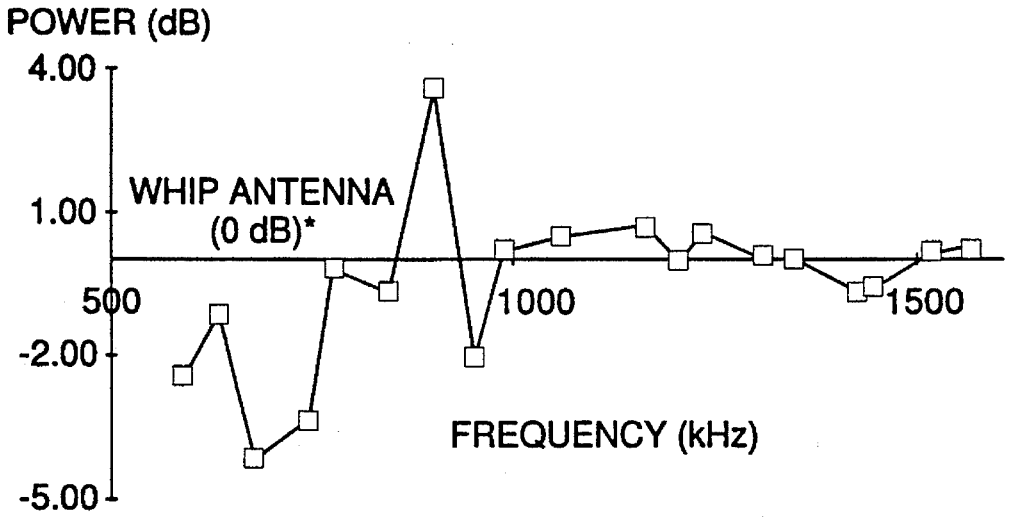
FIG. 8A is a graph of the relative sensitivities of the WTC antenna and a conventional whip antenna at vertically polarized AM frequencies.
Figure 8B:
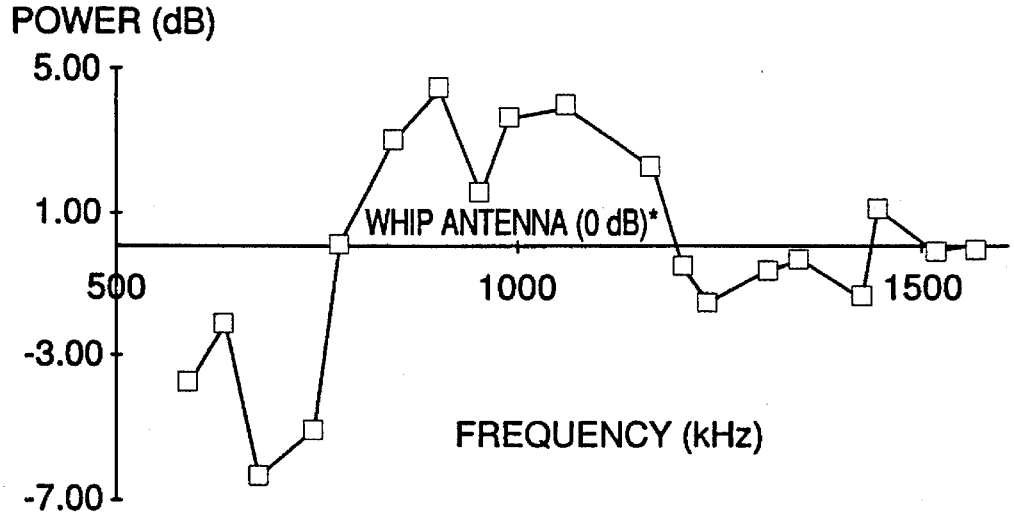
FIG. 8B is a similar graph for horizontal polarization.

FIG. 8A is a graph of the WTC antenna performance in the AM band compared with that of the conventional whip antenna, vertically polarized and normalized to zero. The performance of the WTC antenna is equal to or superior to the whip antenna at most frequencies within the band. FIG. 8B is a similar graph for horizontal polarization.

In addition to the foregoing, the WTC antenna has been found to be generally equal in performance to the whip antenna for cellular telephone and remote keyless entry operation.

From the foregoing, it can readily be seen that the antenna of the present invention has wide frequency bandwidth capability, pattern and polarization diversity, and is conformable and integratable to even the smallest automobile or other vehicle rooftop. The combination of wide frequency bandwidth and conformability is, it is believed, unique to the present invention. In addition, the WTC antenna is readily adaptable to VHF and VHF reception, and to mobile and satellite communications over the range of 100–2200 MHz. The WTC antenna is rugged, low cost, and virtually invisible. It does not have to be retracted, as do whip antennas, when going through an automatic car wash, for example. Throughout the foregoing discussion, specific frequency bands (AM, FM, etc.) have been discussed. The principles and features of the present invention can readily be extended to accommodate other frequencies as well by the process of frequency scaling. Frequency scaling allows change in the antennas physical dimensions, permittivity, and conductivity by simple scaling factors which are determined by the frequency shift to be accomplished.

While the principles and features of the present invention have been disclosed in their application to a vehicle rooftop, they are readily applicable to use on aircraft, missiles and the like. Numerous alterations of, or modifications to, the antenna of the present invention may occur to workers in the art without departure from the spirit and scope of the invention and the principles and features thereof.

We claim:

1. A multifunction conformable antenna for use over a broad frequency range comprising:

a substantially planar spiral mode microstrip (SMM) antenna formed of two or more interleaved arms and having a multimode capability and a finite ground plane;

means for maintaining said SMM antenna and said ground plane in spaced relationship comprising a spacer of dielectric material having a dielectric constant in the range of 1 to 4.5 for supporting said SMM antenna on one surface thereof with said ground plane adjacent the opposite surface thereof;

a loop antenna member substantially surrounding said SMM antenna and spaced therefrom;

connecting means for electrically connecting said loop antenna member to said SMM antenna, said means including means for preventing signals in the FM broadcast band and higher frequencies from passing between said loop antenna and said SMM antenna; and said antenna having a low profile and being conformable to the contour of the surface upon which it is to be mounted.

2. A multifunction conformable antenna as claimed in claim 1 wherein said SMM antenna has first and second input/output terminals approximately at the geometric center thereof.

3. A multifunction conformable antenna as claimed in claim 2 wherein said loop antenna has first and second ends, each of said ends having an input/output terminal.

4. A multifunction conformable antenna as claimed in claim 3 wherein one of said input/output terminals of said loop antenna is connected to the ground plane.

5. A multifunction conformable antenna as claimed in claim 3 and further comprising an AM-broadcast-band-signal-blocking member on said loop antenna between said connecting means and the input/output terminal at one of said first and second ends of said loop antenna.

6. A multifunction conformable antenna as claimed in claim 5 wherein one of said input/output terminals of said loop antenna is connected to the ground plane.

7. A multifunction conformable antenna as claimed in claim 1 wherein said loop antenna has a folded dipole configuration.

8. A multifunction conformable antenna as claimed in claim 7 wherein said loop antenna lies in a plane spaced from the plane of the SMM antenna and parallel thereto.

9. A multifunction conformable antenna as claimed in claim 7 wherein said loop antenna spans the distance between the plane of the SMM antenna and the plane of the ground plane.

10. A multifunction conformable antenna as claimed in claim 1 wherein said loop antenna is supported on one of said surfaces of said spacer member.

11. A shared aperture multifunction conformable antenna for use over a broad frequency range comprising:

a substantially planar multimode spiral mode microstrip (SMM) antenna formed of two or more interleaved arms and having a multimode capability;

first and second input/output terminals connected to different ones of side arms at the approximate center of said SMM antenna, said first and second input/output terminals being configured and adapted to produce a spiral mode reception and radiation pattern of said SMM antenna;

a spacer of dielectric material having a dielectric constant in the range of 1 to 4.5 and having first and second surfaces, and SMM antenna being mounted on said first surface, said second surface being adapted to abut a ground planar member;

a loop antenna member substantially surrounding said SMM antenna and spaced therefrom, said loop antenna member having third and fourth input/output terminals connected thereto;

connecting means electrically connecting said loop antenna to said SMM antenna, said connecting means being adapted to block signals above the AM broadcast band from passing between said loop antenna and said SMM antenna while permitting signals in the AM broadcast band to pass between said loop antenna and said SMM antenna;

AM-broadcast-band-signal blocking means in said loop between sid connecting means and said third input/output terminal; and said antenna being conformable to the contour of the surface upon which it is to be mounted.

12. A multifunction conformable antenna as claimed in claim 11 wherein said loop antenna is mounted on said first surface of said spacer.

13. A multifunction conformable antenna as claimed in claim 11 wherein said loop antenna lies in a plane spaced from the plane of said SMM antenna and parallel thereto.

14. A multifunction conformable antenna as claimed in claim 11 wherein said loop antenna spans the distance between the plane of the SMM antenna and the plane of the ground plane.

15. A multifunction conformable antenna as claimed in claim 11 wherein said connecting means is an inductive choke.

16. A multifunction conformable antenna as claimed in claim 15 wherein said inductive choke has a value of approximately 0.5 micro-henries.

17. A multifunction conformable antenna as claimed in claim 11 wherein said AM-broadcast-band-signal-blocking means is a capacitor.

18. A multifunction conformable antenna as claimed in claim 17 wherein said capacitor has a value of approximately 250 pico-farads.

19. A multifunction conformable antenna as claimed in claim 11 wherein the dimensions of the loop antenna are greater than the dimensions of the ground plane.

20. A multifunction conformable antenna as claimed in claim 11 and further including circuit means connected to said first and second output terminals for receiving and/or transmitting one or more spiral modes.

21. A multifunction conformable antenna as claimed in claim 20 wherein said circuit means is an RF hybrid circuit for generating one or more spiral modes.

22. A multifunction conformable antenna as claimed in claim 20 wherein said circuit means is a balun, for generating one or more spiral modes.

* * * * *